US007967008B2

(12) United States Patent
Ferguson et al.

(10) Patent No.: US 7,967,008 B2
(45) Date of Patent: Jun. 28, 2011

(54) FIREPLACE COMBUSTION SYSTEM

(75) Inventors: Robert W. Ferguson, South Royalton, VT (US); Derik K. Andors, Braintree, VT (US)

(73) Assignee: Incendia IP, LLC, Wilmington, DE (US)

( * ) Notice: Subject to any disclaimer, the term of this patent is extended or adjusted under 35 U.S.C. 154(b) by 401 days.

(21) Appl. No.: 12/199,260

(22) Filed: Aug. 27, 2008

(65) Prior Publication Data

US 2009/0188485 A1 Jul. 30, 2009

Related U.S. Application Data

(60) Provisional application No. 61/062,857, filed on Jan. 30, 2008.

(51) Int. Cl.

| | |
|---|---|
| ***F24B 1/18*** | (2006.01) |
| ***F24B 1/191*** | (2006.01) |
| ***F24B 1/195*** | (2006.01) |
| ***F24C 1/17*** | (2006.01) |
| ***F24C 15/28*** | (2006.01) |

(52) U.S. Cl. ..... 126/500; 126/77; 126/83; 126/505; 126/528; 126/529; 126/531; 126/540; 126/552; 110/210; 110/211

(58) Field of Classification Search ..... 126/500, 126/505, 510, 528, 529, 531, 552, 540, 77, 126/83; 110/210, 211

See application file for complete search history.

(56) References Cited

U.S. PATENT DOCUMENTS

| | | | |
|---|---|---|---|
| 4,180,052 | A | 12/1979 | Henderson |
| 4,213,445 | A | 7/1980 | Mayo |
| 4,487,195 | A | 12/1984 | Syme et al. |
| 4,510,918 | A | 4/1985 | Ferguson et al. |
| 4,582,044 | A | 4/1986 | Ferguson et al. |
| 4,646,712 | A | 3/1987 | Ferguson et al. |
| 4,683,868 | A | 8/1987 | Ferguson et al. |
| 4,856,491 | A | 8/1989 | Ferguson et al. |
| 4,865,011 | A | 9/1989 | Stancliffe et al. |
| 4,883,044 | A | 11/1989 | Levesque |
| 5,010,874 | A | 4/1991 | Toth |
| 5,113,843 | A | 5/1992 | Henry et al. |
| 5,263,471 | A | 11/1993 | Shimek et al. |
| 5,341,794 | A | 8/1994 | Henry et al. |
| 5,413,089 | A | 5/1995 | Andors et al. |
| 5,499,622 | A | 3/1996 | Woods |
| 5,566,667 | A | 10/1996 | Cox |
| 5,701,882 | A | 12/1997 | Champion |
| 6,237,587 | B1 | 5/2001 | Sparling et al. |
| 6,484,714 | B1 | 11/2002 | Smith |
| 6,968,838 | B1 | 11/2005 | Tiegs |
| 7,275,929 | B2 | 10/2007 | Tiegs |

*Primary Examiner* — Kenneth B Rinehart
*Assistant Examiner* — William G Corboy, III
(74) *Attorney, Agent, or Firm* — Holland & Knight LLP; Brian J. Colandreo, Esq.; Elizabeth R. Burkhard, Esq.

(57) ABSTRACT

A fireplace system having a fireplace cavity and a secondary combustion assembly disposed adjacent to a rear wall of the fireplace cavity. The secondary combustion assembly includes a plurality of combustion chambers configured to facilitate secondary combustion. A plurality of inlets are disposed in the rear wall of the fireplace cavity. One or more of the plurality of inlets are configured to provide fluid communication between the fireplace cavity and a respective one of the plurality of combustion chambers. An exhaust gas collection chamber is in fluid communication with at least the secondary combustion assembly. The exhaust gas collection chamber includes a vent configured to release exhaust gas into a chimney. An ambient air bypass aperture is disposed in a top baffle of the fireplace cavity. The ambient air bypass aperture is configured to divert at least a portion of ambient air entering the fireplace cavity into the exhaust gas collection chamber.

17 Claims, 6 Drawing Sheets

FIREPLACE COMBUSTION SYSTEM

CROSS REFERENCE TO RELATED APPLICATIONS

This application claims the benefit of U.S. Provisional Patent Application Ser. No. 61/062,857, entitled A SYSTEM FOR THE REDUCTION OF PARTICULATE EMISSIONS FROM WOOD-BURNING FIREPLACES, filed 30 Jan. 2008, the contents of which are herein incorporated by reference.

FIELD OF THE INVENTION

The present disclosure relates to fireplaces, and more specifically to a system for facilitating secondary combustion in wood burning fireplaces.

BACKGROUND

Wood-burning fireplaces have been used for centuries in homes throughout the world. They have provided a means of heating and cooking. More recently, they have taken a more aesthetic role as more efficient and convenient means of heating and cooking have evolved. Today, fireplaces are considered a desirable feature in any home and are often the gathering point or focal point for special occasions. It is often said that the warmth and security they provide fill an instinctual need left over from man's earliest ancestors. In any case, people are simply drawn to an open fire. The number of existing fireplaces in the United States is estimated in the tens of millions. The number of new fireplaces installed in the United States is estimated in the hundreds of thousands each year.

Wood combustion does have its drawbacks. The incomplete combustion of wood can result in various forms of air pollution. For example, volatile organic materials may be released during the combustion process (referred to a pyrolysis) and if not substantially oxidized (burned) before entering the chimney, wood smoke is produced. Notable among the pollutants comprising wood smoke is fine particulate matter of a size that is easily respirated into the deepest parts of the lungs. The potential health impacts from this are well documented. For this reason, residential wood burning has come under close scrutiny. For example, Oregon, Colorado, Washington State and the U.S. Environmental Protection Agency have been regulating particulate emissions from several categories of wood-burning devices since the mid-1980's.

However, these regulations, for the most part, and the EPA regulations specifically, have excluded traditional wood-burning fireplaces. This was done for several reasons. It was recognized that the vast majority of wood-burning fireplaces are used on a very infrequent basis and primarily for aesthetic enjoyment. The total amount of wood consumed in fireplaces was low when compared to other residential wood-burning devices such as wood stoves that are used for heating. This meant that the total contribution, relative to other known sources, was quite low. Also, at the time the EPA regulations were being formulated, it was recognized that there was no viable particulate emission control technology that was applicable to fireplaces.

As an increasing number of air quality regulators have begun to face more stringent National Ambient Air Quality Standards for fine particulates in their jurisdictions, they have been forced to start looking at other lower level sources and specifically at sources that are currently uncontrolled. Traditional wood-burning fireplaces fall into this category. It is generally recognized that traditional wood-burning fireplaces must begin to show a significant improvement in particulate emission performance or face the possibility that they will no longer be able to be built or installed in wide-ranging areas throughout the country.

The wood-burning emission control development efforts for the past 25 years have been focused almost exclusively on wood-burning stoves and it is generally understood by those skilled in the art that those control technologies can not be directly applied to fireplaces due to the fundamental differences in the size, design and use patterns between the two. Woodstoves have relatively small fireboxes, are generally batch-loaded with nearly full fuel loads and have tight-fitting load doors.

Fireplaces, on the other hand, have much larger fireboxes, more properly called a fireplace cavity and may be fueled with small fuel loads relative to the total fireplace cavity volume. Some fireplaces may include fire screens (to contain sparks and embers) in front of large front fireplace openings. Large amounts of air may enter the fireplace cavity through the open face of the fireplace. Some of the air entering near the bottom of the fireplace flows to the burning fuel load providing the oxygen needed to sustain combustion of the fuel. Some of the air entering at the upper portions of the fireplace opening simply bypasses the actual combustion occurring in and around the fuel load and flows over the fire and directly up the chimney, providing the benefit of sweeping up and carrying away any stray smoke before it can spill into the room. However, this air also can have the detrimental impact of diluting and quenching the natural secondary combustion of the gaseous and volatile organic materials emanating from the burning fuel load.

The aesthetically pleasing yellow flames that are seen propagating above an actively burning fuel load are the natural secondary combustion of the gases and volatile materials. When excess air mixes with those flames, the temperature drops and combustion is halted before all of the combustible materials have been completely burned. The unburned materials form the smoke (and unwanted pollutant materials) that you see exiting the chimney. Even those fireplaces with typical bi-fold glass doors on the front do little to control the large volumes of air being drawn into the fireplace and therefore have only minimal impact in improving the combustion environment. This continuous high excess air condition represents the primary difference between wood-burning stoves and wood-burning fireplaces and is the reason that particulate emission control technology that has been shown to be very effective in wood stoves will not translate directly to fireplaces.

Since air flow is not readily controlled in a fireplace, other ways of dividing and guiding air to the needed locations while diverting some of the unwanted excess air away from the fire must be employed. If this can be accomplished, in combination with providing a favorable environment in terms of temperature and mixing, secondary combustion of the pollutant emissions can be initiated and sustained over a significant portion of the fireplace burn cycle. Thus, there exists a need for a secondary combustion system for wood burning fireplaces that is configured to assist in controlling air flow to maximize secondary combustion.

SUMMARY

In an exemplary embodiment, a fireplace system includes a fireplace cavity. A secondary combustion assembly is disposed adjacent to a rear wall of the fireplace cavity. The secondary combustion assembly includes a plurality of combustion chambers configured to facilitate secondary combustion. A plurality of inlets are disposed in the rear wall of the fireplace cavity. One or more of the plurality of inlets are configured to provide fluid communication between the fireplace cavity and a respective one of the plurality of combustion chambers. An exhaust gas collection chamber is in fluid communication with at least the secondary combustion assembly. The exhaust gas collection chamber includes a vent configured to release exhaust gas into a chimney. An ambient air bypass aperture is disposed in a top baffle of the fireplace cavity. The ambient air bypass aperture is configured to divert at least a portion of ambient air entering the fireplace cavity into the exhaust gas collection chamber.

One or more of the following features may be included. The plurality of combustion chambers may include at least one or more lower level combustion chambers. One or more intermediate level combustion chambers may be disposed above the one or more lower level combustion chambers. One or more upper level combustion chambers may be disposed above the one or more intermediate level combustion chambers.

The one or more lower level combustion chambers may include one or more lower inlet openings in fluid communication with one or more of the plurality of inlets disposed in the rear wall of the fireplace cavity. The one or more intermediate level combustion chambers may include one or more intermediate inlet openings in fluid communication with one or more of the plurality of inlets disposed in the rear wall of the fireplace cavity. The one or more upper level combustion chambers may include one or more upper inlet openings in fluid communication with one or more of the plurality of inlets disposed in the rear wall of the fireplace cavity. The one or more lower inlet openings, the one or more intermediate inlet openings and the one or more upper inlet openings may be disposed in a front wall of the secondary combustion assembly.

The one or more intermediate level combustion chambers may be in an offset configuration with the one or more lower level combustion chambers. Each of the one or more lower level combustion chambers and the one or more intermediate level combustion chambers may include an outlet opening in fluid communication with one or more of the one or more upper level combustion chambers. One or more of the one or more upper level combustion chambers may include an outlet opening in fluid communication with the exhaust gas collection chamber.

The secondary combustion assembly may be formed from one or more refractory materials. At least the rear wall of the fireplace cavity may be formed from one or more refractory materials. The one or more refractory materials may include at least one of a low density highly insulating material and a high density high durability material. The top baffle may be formed from one or more of a metallic material and a refractory material.

The fireplace system may include a grate configured to retain a fuel load, wherein the grate is sloped downward toward the rear wall of the fireplace cavity. A segmented high temperature high density refractory material may be disposed on at least a base portion of the grate. A plurality of venting apertures may be disposed in a front portion of the grate. One or more fuel retention bars may be disposed adjacent to the front portion of the grate.

At least a portion of the plurality of combustion chambers may include a common wall portion. One or more flow directors may extend into one or more of the one or more lower level combustion chambers, the one or more intermediate level combustion chambers, and the one or more upper level combustion chambers. One or more flow interrupters may extend into one or more of the one or more lower level combustion chambers, the one or more intermediate level combustion chambers, and the one or more upper level combustion chambers. The one or more flow interrupters may include one or more of a cone shape, a pyramid shape, a dome shape, a cylinder shape, and a block shape.

In a second exemplary embodiment, a retrofit fireplace assembly includes a secondary combustion assembly configured for insertion adjacent to a rear wall of a fireplace cavity. The secondary combustion assembly includes a plurality of combustion chambers configured to facilitate secondary combustion. The plurality of combustion chambers include one or more lower level combustion chambers and one or more intermediate level combustion chambers disposed above the one or more lower level combustion chambers.

The retrofit fireplace assembly may also include one or more upper level combustion chambers disposed above the one or more intermediate level combustion chambers. A plurality of inlet openings are disposed in a front wall of the secondary combustion assembly. One or more of the plurality of inlet openings are configured to provide fluid communication between the fireplace cavity and a respective one of the plurality of combustion chambers.

One or more of the following features may be included. Each of the one or more lower level combustion chambers and the one or more intermediate level combustion chambers may include an outlet opening in fluid communication with one or more of the one or more upper level combustion chambers. The plurality of inlet openings may include one or more lower inlet openings configured to provide fluid communication from the fireplace cavity to the one or more lower level combustion chambers, one or more intermediate inlet openings configured to provide fluid communication from the fireplace cavity to the one or more intermediate level combustion chambers, and one or more upper inlet openings configured to provide fluid communication from the fireplace cavity to the one or more upper level combustion chambers. The one or more lower inlet openings, the one or more intermediate inlet openings and the one or more upper inlet openings correspond to one or more of a plurality of inlets in a rear wall of the fireplace cavity.

The retrofit fireplace assembly may include one or more flow directors extending into one or more of the one or more lower level combustion chambers, the one or more intermediate level combustion chambers, and the one or more upper level combustion chambers. The retrofit fireplace assembly may further include one or more flow interrupters extending into one or more of the one or more lower level combustion chambers, the one or more intermediate level combustion chambers, and the one or more upper level combustion chambers.

The fireplace system may be implemented to realize one or more of the following advantages. For example, the secondary combustion assembly can be incorporated into new fireplaces or can be made as a retrofit fireplace assembly for insertion in existing fireplace cavities. Loose-fitting or tight-fitting doors may be added to the front fireplace opening and would not detract from the benefits of this fireplace system and can be made to be an integral part of the design, if so desired. The sloping grate may include a base section made of high-density refractory firebrick material segmented in such a way to allow ash to fall through while limiting under-fire air to the fuel load, by limiting and controlling the under-fire air passing through the grate, more controllable and therefore more favorable conditions can be maintained. A portion of the excess air entering at the upper portions of the front fireplace opening may be diverted away from the fire and away from the secondary combustion matrix and directed to the chimney such that any stray smoke from the fire is collected by that flow of that air so as to prevent spillage of stray smoke into the room.

The details of one or more embodiments are set forth in the accompanying drawings and the description below. Other features and advantages will become apparent from the description, the drawings, and the claims.

DETAILED DESCRIPTION

Figure 1:
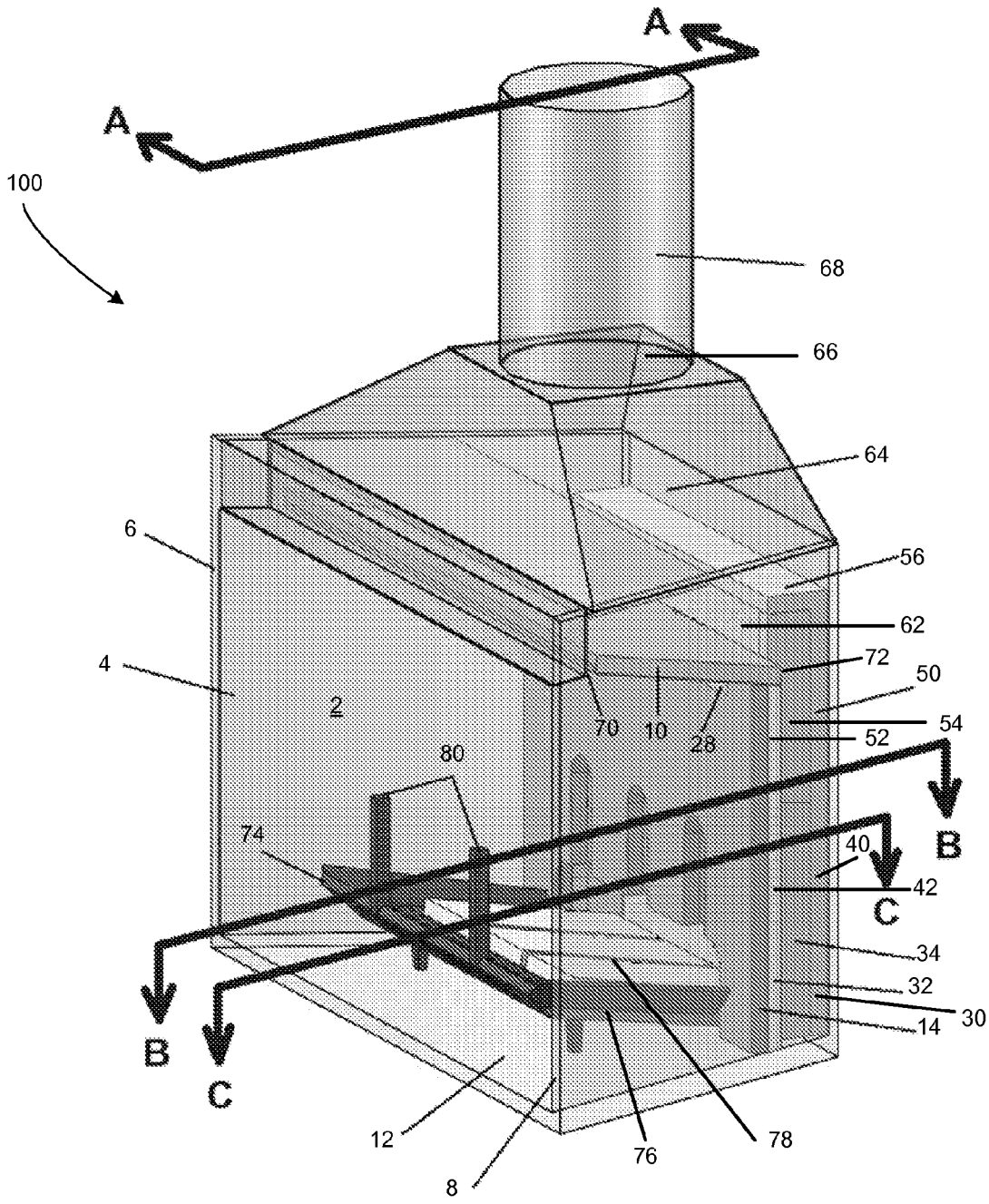
FIG. 1 is a perspective view of an exemplary fireplace system.
Figure 2:
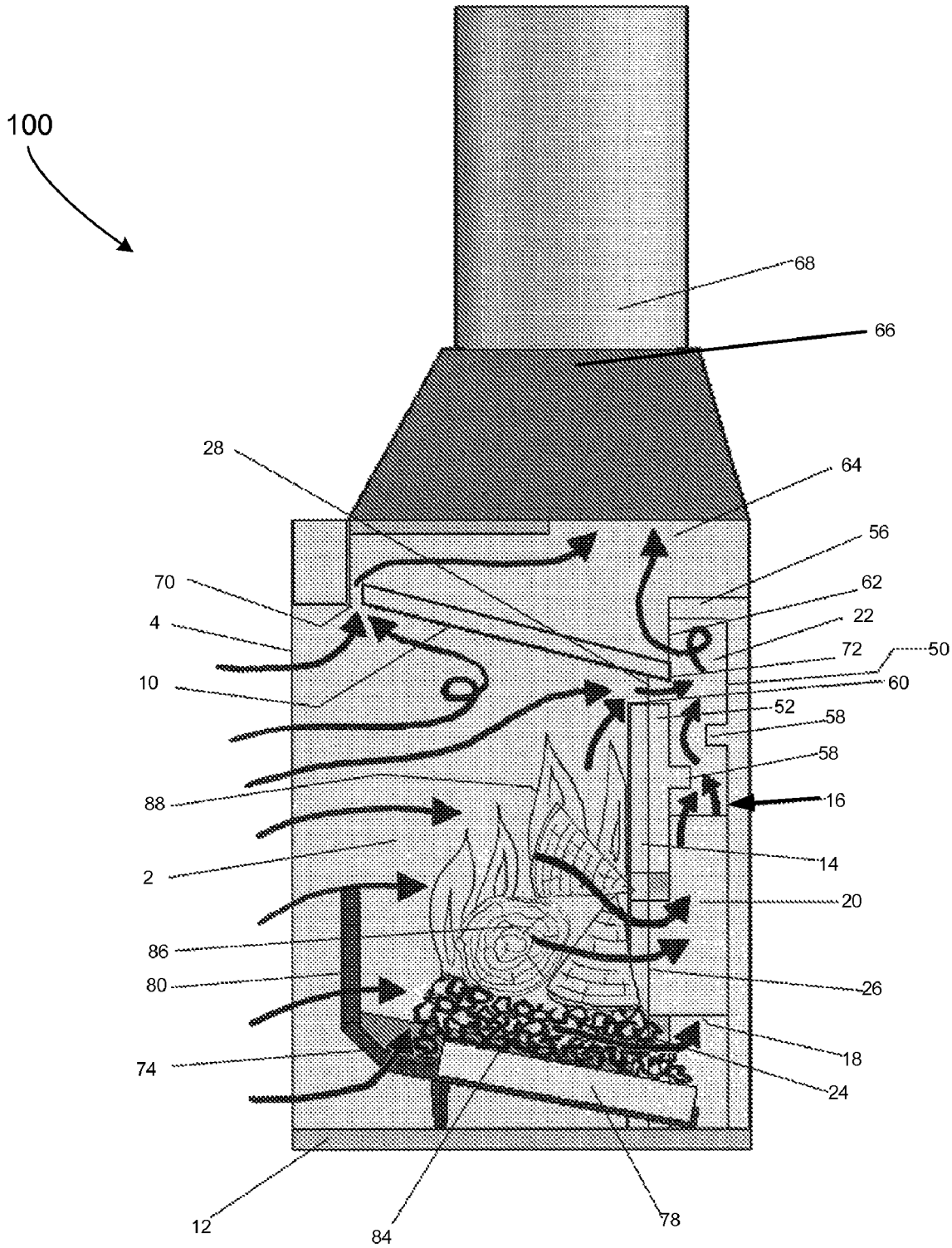
FIG. 2 is a cross-sectional view taken according to the A-A centerline of the fireplace system of FIG. 1.
Figure 3:
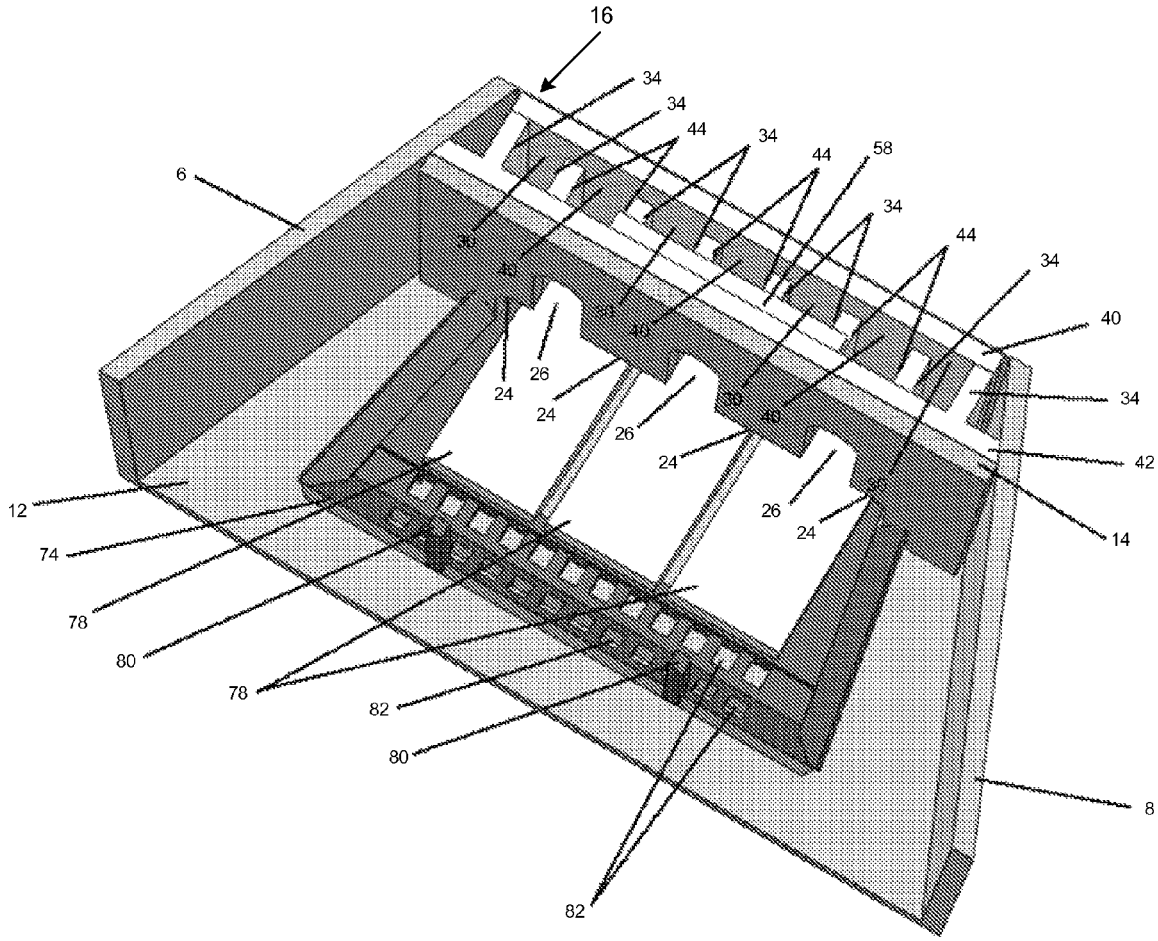
FIG. 3 is a cross-sectional view taken according to the B-B line of the fireplace system of FIG. 1.
Figure 4:
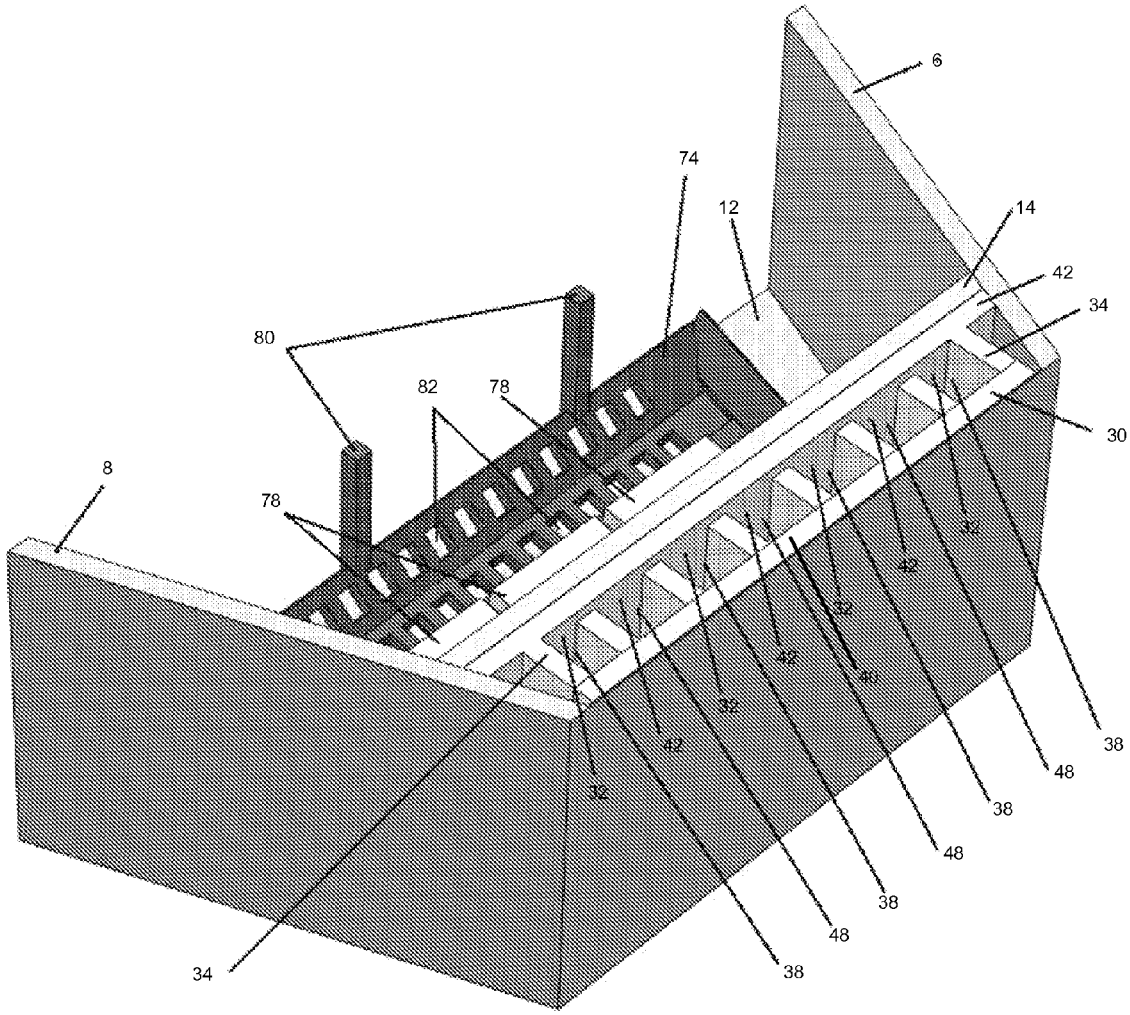
FIG. 4 is a cross-sectional view taken according to the C-C line of the fireplace system of FIG. 1.
Figure 5:
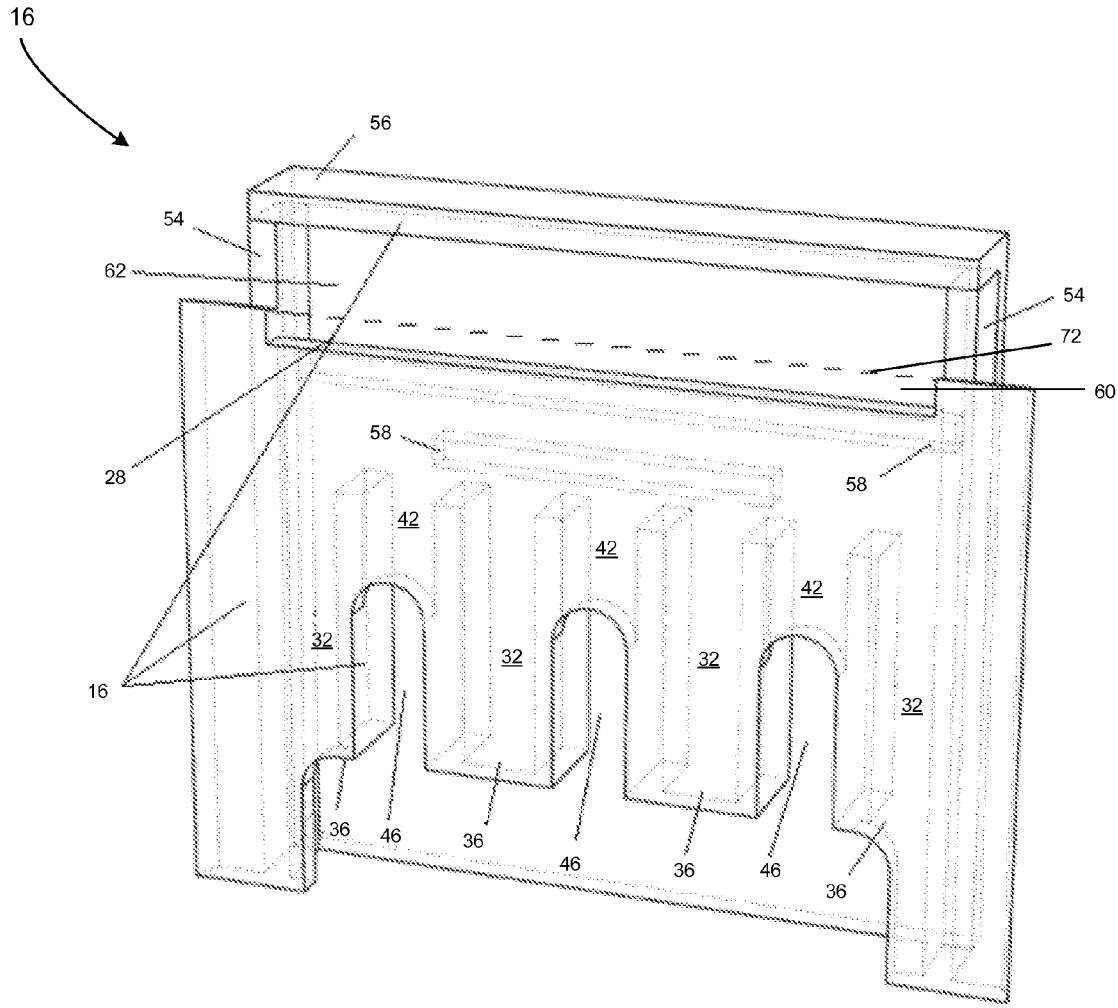
FIG. 5 is a perspective view of an exemplary secondary combustion assembly of the fireplace system of FIG. 1.

As seen in FIG. 1, an exemplary fireplace system 100 may include a fireplace cavity 2. The fireplace cavity 2 may be defined by a front fireplace opening 4, left and right side walls 6 and 8, a top baffle 10, a hearth 12, and a rear wall 14. Loose fitting or tight-fitting doors (not shown) configured for enclosing the front fireplace opening 4 of the fireplace cavity 2 may also be included.

A fuel material, for example wood or other suitable material, may be loaded into the fireplace cavity 2 for burning to provide heat and/or for aesthetic purposes. Portions of the fireplace cavity 2, such as rear wall 14 may be made of a highly durable material configured to withstand high temperatures and to the physical abuse present during the loading and/or stoking of a fire.

In some embodiments, portions of fireplace cavity 2 may be constructed out of a castable refractory material having internal reinforcement. Of course, numerous other materials may be used and other constructions are also within the scope of the present disclosure. For example, the material composition of top baffle 10 may be metallic and/or refractory. The shape of top baffle 10 may be flat, curved, pyramidal, conical or domed depending on the overall geometry and dimensions of the fireplace cavity 2.

Referring also to FIGS. 2-5, a secondary combustion assembly 16 may be disposed adjacent to and/or behind the rear wall 14 of the fireplace cavity 2. The secondary combustion assembly 16 may include a plurality of combustion chambers, e.g., lower level combustion chamber 18, intermediate level combustion chamber 20 and upper level combustion chamber 22, which all may be configured to assist in the facilitation of secondary combustion. Certain embodiments may include more than one of each individual chamber.

The secondary combustion assembly 16 may be constructed out of a variety of different materials, including, but not limited to, a combination high temperature capability, highly insulating refractory material which has the thermal quality of helping to maintain the elevated temperatures needed within the plurality of combustion chambers. Secondary combustion assembly 16 may also be constructed out of a high density, high durability refractory material for the portions of the secondary combustion assembly 16 that are exposed directly to the fireplace cavity 2 and to the fuel load itself. The secondary combustion assembly 16 may be in fluid or gaseous communication with the fireplace cavity 2, as will be discussed in more detail below.

Referring to FIGS. 1-5, the rear wall 14 of fireplace cavity 2 is shown in alignment with secondary combustion assembly 16. A plurality of inlets, e.g., lower inlets 24, intermediate inlets 26, and upper inlets 28, are disposed in the rear wall 14 of the fireplace cavity 2. One or more of the plurality of inlets may be configured to provide gaseous and/or fluid communication between the fireplace cavity 2 and a respective one of the plurality of combustion chambers 18, 20 and/or 22, allowing gaseous, volatile organic materials and air to flow from the fireplace cavity 2 into the secondary combustion assembly 16. The plurality of inlets 24, 26 and/or 28 may be disposed in the rear wall 14 at positions that correspond to locations in the fireplace cavity 2. For example, lower inlets 24 may be positioned to correspond generally with a height of charcoal bed 84 that typically builds below a wood fire. Positioning the lower inlets 24 in proximity to the charcoal bed 84 allows the gases and volatile organic material produced by the burning and pyrolysis of the fuel load, as well as air from the fireplace cavity 2, to flow through and around the charcoal bed 84 as they are drawn toward the lower inlets 24. This enables an elevation in temperature of the flow stream containing those gases and volatile materials as energy is extracted from the burning charcoal and excess air is consumed by the burning charcoal. The reduction of excess air may enrich the fuel quality of the gaseous and volatile organic material stream entering the lower inlets 24 as diluting air may be reduced. The temperature of the flow stream may be thereby increased as less energy extracted from the fire is wasted in heating unwanted excess air. The number of inlets at this lower level may vary, though four or more lower inlets have been found to be effective.

Intermediate inlets 26 may be positioned in the rear wall 14 to correspond generally with an area that may correspond to the middle 86 of a burning fuel load. The intermediate inlets 26 may have an elongate shape, and in some embodiments the vertical dimension may exceed the horizontal dimension. This may assist in facilitating the flow of the gaseous and volatile organic material stream even when a lower portion of the intermediate inlets 26 may be blocked by fuel pieces from the fuel load. Positioning the intermediate inlets 26 in proximity to an area roughly corresponding to the middle 86 of a burning fuel load allows the gases and volatile organic material produced by the burning and pyrolysis of the fuel load, as well as air from the fireplace cavity 2, to flow through and around the burning fuel load as they are drawn toward the intermediate inlets 26. As discussed above, this may enable an elevation in temperature of the flow stream containing those gases and volatile materials as energy is extracted from the burning fuel load and excess air is reduced as it is consumed by the burning fuel load, thereby enriching the fuel quality of the gaseous and volatile organic material stream entering the intermediate inlets 26. The number of inlets at this intermediate level may vary, though three or more intermediate inlets have been found to be effective.

Upper inlets 28 may be positioned in the rear wall 14 to correspond generally with the active flaming 88 that typically occurs above a mass of burning fuel load. The gases drawn into this opening or openings may at certain times be elevated in temperature and at other times have a lower temperature depending on what stage of the combustion is occurring in the fuel load. When the fuel load is burning in a fully-engaged fashion with visible, active flaming 88 above the fuel mass, the temperatures of the gases may be elevated. In the beginning and later stages of the fire, when there is less vigorous combustion occurring in and around the fuel load, the temperatures of these gases may be lower. The gases entering the upper inlet 28 generally are more diluted with air and at a lower temperature than those entering the intermediate inlets 26 and lower inlets 24. The number of inlets 28 at this upper level may vary, though a single elongated opening oriented horizontally across the rear wall 14 of the fireplace cavity 2 has been found to be effective for the upper inlet. Of course, other configurations are also within the scope of the present disclosure.

As discussed above, the secondary combustion assembly 16 may include a plurality of combustion chambers, which may include at least one lower level combustion chamber 18. The lower level combustion chambers 18 may be positioned in the secondary combustion assembly 16 approximately normal to the direction of the gaseous flow from lower inlets 24, thereby causing the gases to impinge on the rear walls 30 of lower level combustion chamber 18 as they change direction. This action may improve mixing of the gases, further encouraging combustion. Heat may be absorbed from the burning gas stream and re-radiated back to the gases from the highly insulative front walls 32, side walls 34 and rear walls 30 of the lower level combustion chamber 18, helping to maintain the elevated temperatures needed to stimulate combustion of the gases and other volatile organic materials contained in the gas flow stream. In some embodiments, the width and depth of the lower level combustion chamber 18 may be approximately equal. A total cross-sectional area of each individual chamber in the range of four to six square inches has been shown to be effective, though other dimensions may be utilized. Other cross-sectional shapes for the lower level combustion chambers 18, such as round or oval, have also been shown to be effective and may also be utilized.

The lower level combustion chamber 18 may also include one or more lower inlet openings 36 in fluid communication with one or more of the plurality of inlets disposed in the rear wall 14 of the fireplace cavity 2, e.g., the lower inlets 24. For example, an air/gas mixture may flow through the lower inlet 24 of rear wall 14 before entering lower inlet opening 36 of secondary combustion assembly 16.

The one or more lower inlet openings may be disposed in the front wall 32 of the lower level combustion chambers 18 of the secondary combustion assembly 16. Lower inlet openings 36 may permit the flow of a variable mixture of gases, volatile organic material and air from the fireplace cavity 2 to the lower level combustion chamber 18. Additionally, the lower level combustion chamber 18 may have an outlet opening 38 at the top of the lower level combustion chamber 18, as will be discussed in more detail below.

As discussed above, the secondary combustion assembly 16 includes a plurality of combustion chambers, which may include at least one or more intermediate level combustion chambers 20 disposed adjacent to and/or above the one or more lower level combustion chambers 18. In some embodiments, the intermediate level combustion chambers 20 may be in an offset or alternating configuration with the lower level combustion chambers 18. The intermediate level combustion chambers 20 may be positioned in the secondary combustion assembly 16 approximately normal to the direction of the gaseous flow from intermediate inlets 26, thereby causing the gases to impinge on the rear walls 40 of intermediate level combustion chambers 20 as they change direction. As in the lower level combustion chambers 18, this action improves mixing of the gases, further encouraging combustion, and heat from the burning gas stream may be absorbed and re-radiated back to the gases from the highly insulative front walls 42, side walls 44 and rear walls 40 of the intermediate level combustion chambers 20. This may help to maintain the elevated temperatures needed to stimulate combustion of the gases and other volatile organic materials contained in the gas flow stream. The intermediate level combustion chambers 20 may have a variety of different configurations. For example, the width and depth of the intermediate level combustion chambers 20 may be approximately equal and a total cross-sectional area of each individual chamber in the range of four to six square inches may be used, though other dimensions may be utilized. Other cross-sectional shapes for the intermediate level combustion chambers 20, such as round or oval, have also been shown to be effective and may also be utilized.

The intermediate level combustion chambers 20 may include one or more intermediate inlet openings 46 in fluid communication with one or more of the plurality of inlets disposed in the rear wall 14 of the fireplace cavity 2, e.g., the intermediate inlets 26. The one or more intermediate inlet openings 46 may be disposed in the front wall 42 of the intermediate level combustion chambers 20 of the secondary combustion assembly 16. Intermediate inlet openings 46 may provide gaseous or fluid communication of a variable mixture of gases, volatile organic material and air from the fireplace cavity to the intermediate level combustion chambers 20. Additionally, the intermediate level combustion chambers 20 may have an outlet opening 48 at the top of the intermediate level combustion chambers 20, as will be discussed in more detail below.

As discussed above, the secondary combustion assembly 16 includes a plurality of combustion chambers, which may include at least one upper level combustion chamber 22 disposed above and in gaseous communication with the lower level combustion chambers 18 and the intermediate level combustion chambers 20. The upper level combustion chambers 22 may include a rear wall 50, front wall 52, side walls 54, and a top surface 56. The dimensions of the upper level combustion chambers 22 may be such that the width and depth of the upper level combustion chambers 22 corresponds to the total width and depth of the lower level combustion chambers 18 and the intermediate level combustion chambers 20 directly below. The total height of the upper level combustion chambers 22 may be approximately one-third of the total height of the secondary combustion assembly 16.

One or more flow directors may extend into one or more of the one or more lower level combustion chambers 18, the one or more intermediate level combustion chambers 20, and the one or more upper level combustion chambers 22. As used herein, "flow director" may refer to a baffle or any other assembly or mechanism suitable for disturbing the combustible gas and air flow through the secondary combustion assembly 16. For example, the upper level combustion chambers 22 may additionally include baffles 58 positioned on one or more of the rear wall 50 and front wall 52 of the upper level combustion chambers 22 to interrupt the smooth flow of combustion gases along the combustion chamber surfaces, further promoting mixing of the combustible gases and air entering the upper level combustion chamber 22 from the fireplace cavity 2 as well as from the lower level combustion chamber 18 and the intermediate level combustion chamber 20. The size and placement of the baffles 58 are such that flow of the gases is not overly restricted. For example, the baffles 58 may be approximately one-third the depth of the upper level combustion chambers 22 and may be positioned generally parallel to the top surface 56 of the upper level combustion chambers 22 although other baffle configurations or dimensions may be utilized and may be equally as effective. The baffles 58 may cause a mixing of the combustible gases and air within the upper level combustion chambers 22 to provide a more homogenous mixture of the gases entering from the one or more lower level combustion chambers 18 and the one or more intermediate level combustion chambers 20, thereby further promoting combustion.

The upper level combustion chamber 22 may include one or more upper inlet openings 60 in fluid communication with one or more of the plurality of inlets disposed in the rear wall of the fireplace cavity e.g., the upper inlets 28. The one or more upper inlet openings 60 may be disposed in the front wall 52 of the upper level combustion chambers 22 of secondary combustion assembly 16. Upper inlet openings 60 may provide gaseous or fluid communication from the fireplace cavity 2 to the upper level combustion chambers 22.

As discussed above, the lower level combustion chamber 18 and the intermediate level combustion chamber 20 may include one or more outlet openings 38, 48 in fluid or gaseous communication with upper level combustion chamber 22. The outlet openings 38, 48 may be located vertically at about two-thirds of the overall height of the secondary combustion assembly 16. Exhaust gases and air may pass through the outlet openings 38, 48 from the lower level combustion chamber 18 and the intermediate level combustion chamber 20 to the upper level combustion chamber 22. Each upper level combustion chamber 22 may include an outlet opening 62 in fluid communication with an exhaust gas collection chamber 64. The outlet opening 62 may be formed between the top surface 56 and the rear wall 50 of the upper level combustion chambers 22.

The exhaust gas collection chamber 64 may be in fluid communication with at least the secondary combustion assembly 16, e.g., through outlet opening 62 in upper level combustion chamber 22. The exhaust gas collection chamber 64 may include a vent 66 configured to release exhaust gas into a chimney 68. Exhaust gases from the fireplace cavity 2 and the secondary combustion assembly 16 may collect in the exhaust gas collection chamber 64 before exiting the fireplace system through the chimney 68. Additionally, ambient air may mix with the exhaust gases in the exhaust gas collection chamber 64, as will be described in more detail below.

An ambient air bypass aperture 70 may be disposed in the top baffle 10 of the fireplace cavity 2. The ambient air bypass aperture 70 may be configured to divert at least a portion of ambient air entering the fireplace cavity, from the room the fireplace system is located in, into the exhaust gas collection chamber 64. Stray smoke from the fire may be collected by that flow of air through the ambient air bypass aperture 70 so as to prevent spillage of stray smoke into the room. The width of the ambient air bypass aperture 70 may be approximately equal to the width of the front fireplace opening 4. The area of the ambient air bypass aperture 70 is proportional to the volume of the fireplace cavity 2 and the cross-sectional area of the front fireplace opening 4. Generally, larger fireplaces require larger ambient air bypass apertures 70. The diversion of air through ambient air bypass aperture 70 away from the burning fuel load has the further benefit of reducing excess air that might otherwise reach the burning fuel load causing an undesirable dilution of the gases and volatile organic materials emanating from the fire and entering the secondary combustion assembly 16. This dilution effect, if not reduced or controlled by the aspects of this invention, may reduce the temperature of the gases/volatile materials and increase the ratio of air to fuel to the point where secondary combustion will be inhibited.

As discussed above, the fireplace cavity 2 may include a top baffle 10, which forms the top of the fireplace cavity 2. The top baffle 10 may generally slope downward from the front of the fireplace cavity 2 to the rear wall 14 of fireplace cavity 2. The rear edge 72 of top baffle 10 forms the top of the upper inlets 28 in rear wall 14. The rear edge 72 of top baffle 10 may also form the top of the one or more upper inlet openings 60 of the secondary combustion assembly 16. The rear edge 72 of top baffle 10 may also form the bottom of the upper level combustion chamber 22 outlet opening(s) 62.

At least a portion of the plurality of combustion chambers may include a common wall portion. The secondary combustion assembly 16 may most effectively and efficiently be made as an assembly where some parts are commonly shared between adjacent combustion chambers. For example, combustion chamber rear walls 30, 40, 50 may be formed from a single piece of material that forms the entire rear wall of the secondary combustion assembly 16. Combustion chamber front walls 32, 42, 52 may be formed from a single piece of material that forms the entire front wall of the secondary combustion assembly 16. Interior combustion chamber side walls 34, 44 may be shared between the lower level combustion chambers 18 and intermediate level combustion chambers 20. Exterior side walls 34, 54 of the secondary combustion assembly 16 may be shared between the lower level combustion chambers 18 and upper level combustion chambers 22.

The fireplace system 100 may include a grate 74 configured to retain a fuel load, wherein the grate 74 is sloped downward toward the rear wall 14 of the fireplace cavity 2. The grate 74 may include a metal support frame 76, a segmented high temperature high density refractory firebrick lining 78 and front fuel retainer bars or andirons 80. The grate 74 may slope generally from the front of the fireplace cavity 2 downward toward and into the lower inlets 24 in the rear wall 14. This sloping fuel grate 74 encourages the wood pieces that comprise the fuel load, as well as the underlying charcoal material that results from the burning of the kindling fuel and main fuel load, to generally be directed towards the back of the fireplace cavity 2 and towards the plurality of inlets to the secondary combustion assembly 16. The segmented high temperature, high density refractory firebrick lining 78 of the base of the grate 74 helps to block undesirable amounts of under-fire air from reaching the burning fuel load while still allowing some ash to filter out from under the fire. The mass of the high density refractory firebrick lining 78 also helps maintain higher temperatures within the gases entering the lower inlets 24 to the secondary combustion assembly 16 while also providing a layer of protection for the metal support frame 76 and any other metallic grate parts that might otherwise suffer from durability problems caused by elevated temperatures in the fuel load and charcoal bed 84. The grate 74 also includes a plurality of openings 82 near the front of the grate 74 to allow ash to fall through and to allow air to flow upward near the front of the fuel load. The front fuel retainer bars or andirons 80 located at the front of the grate 74 may prevent fuel pieces within the fuel load from falling forward. This both helps to maintain the fuel load in a configuration that encourages the fuel pieces to burn and prevents the potentially unsafe condition that would result from burning fuel pieces falling off the grate 74 and out of the fireplace cavity 2.

Figure 6:
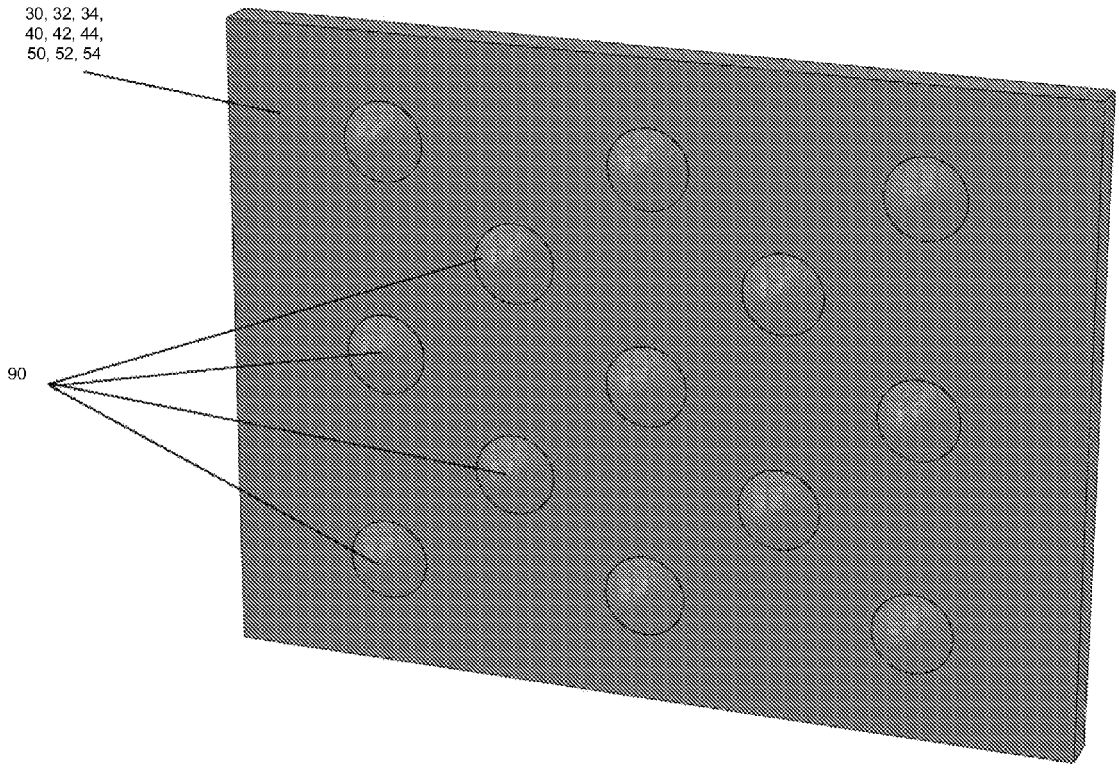
FIG. 6 is a perspective view of an exemplary secondary combustion assembly wall with flow interrupters.

Also referring to FIG. 6, one or more flow interrupters 90 may extend into one or more of the one or more lower level combustion chambers 18, the one or more intermediate level combustion chambers 20, and the one or more upper level combustion chambers 22. For example, one or more flow interrupters 90 may extend into the lower level combustion chambers 18, the intermediate level combustion chambers 20 and the upper level combustion chambers 22. Flow interrupters 90 may be positioned on one or more of the rear wall 30, 40, 50 front wall 32, 42, 52 and/or side walls 34, 44, 54 to interrupt the smooth flow of combustion gases along the combustion chamber surfaces, further promoting mixing of the combustible gases and air. The size and placement of the flow interrupters 90 are such that flow of said gases is not overly restricted. The flow interrupters 90 may break up the flow along the walls, thereby improving mixing and providing more surface area to re-radiate heat back to the gas stream. The flow interrupters 90 may be staggered to provide maximum benefit without impairing the flow too much. The flow interrupters 90 may be protrusions having a cone shape, a pyramid shape, a dome shape, a cylinder shape, a block shape, or any other suitable configuration. Although the description refers to protrusions, it should be noted that depressions, and other shapes configured to alter the direction of the flow of air and gaseous material are also envisioned.

It should be noted that various aspects of the fireplace system may exist as separate components. For example, any or all of secondary combustion assembly 16 may be provided as a retrofit fireplace assembly, which may be inserted as an after-market item into an existing fireplace.

It is to be understood that the foregoing description is intended to illustrate and not to limit the scope of the invention, which is defined by the scope of the appended claims. Other embodiments are within the scope of the following claims.

What is claimed is:

1. A fireplace system comprising:

a fireplace cavity;

a secondary combustion assembly disposed adjacent to a rear wall of the fireplace cavity, wherein the secondary combustion assembly includes a plurality of combustion chambers configured to facilitate secondary combustion;

a plurality of inlets disposed in the rear wall of the fireplace cavity, wherein one or more of the plurality of inlets are configured to provide fluid communication between the fireplace cavity and a respective one of the plurality of combustion chambers;

an exhaust gas collection chamber in fluid communication with at least the secondary combustion assembly, the exhaust gas collection chamber including a vent configured to release exhaust gas into a chimney; and an ambient air bypass aperture disposed in a top baffle of the fireplace cavity, the ambient air bypass aperture configured to divert at least a portion of ambient air entering the fireplace cavity into the exhaust gas collection chamber;

wherein the plurality of combustion chambers include at least:

one or more lower level combustion chambers, wherein the one or more lower level combustion chambers include one or more lower inlet openings disposed in a front wall of the secondary combustion assembly in fluid communication with one or more of the plurality of inlets disposed in the rear wall of the fireplace cavity;

one or more intermediate level combustion chambers disposed above the one or more lower level combustion chambers, wherein the one or more intermediate level combustion chambers include one or more intermediate inlet openings disposed in a front wall of the secondary combustion assembly in fluid communication with one or more of the plurality of inlets disposed in the rear wall of the fireplace cavity; and one or more upper level combustion chambers disposed above the one or more intermediate level combustion chambers, wherein the one or more upper level combustion chambers include one or more upper inlet openings disposed in a front wall of the secondary combustion assembly in fluid communication with one or more of the plurality of inlets disposed in the rear wall of the fireplace cavity.

2. The fireplace system of claim 1, wherein at least the rear wall of the fireplace cavity is formed from one or more refractory materials.

3. The fireplace system of claim 1, wherein the one or more intermediate level combustion chambers are in an offset configuration with the one or more lower level combustion chambers.

4. The fireplace system of claim 1, wherein each of the one or more lower level combustion chambers and the one or more intermediate level combustion chambers include an outlet opening in fluid communication with one or more of the one or more upper level combustion chambers.

5. The fireplace system of claim 1, wherein one or more of the one or more upper level combustion chambers include an outlet opening in fluid communication with the exhaust gas collection chamber.

6. The fireplace system of claim 1, wherein the secondary combustion assembly is formed from one or more refractory materials.

7. The fireplace system of claim 6, wherein the one or more refractory materials include at least one of a low density highly insulating material and a high density high durability material.

8. The fireplace system of claim 1, further comprising a grate configured to retain a fuel load, wherein the grate is sloped downward toward the rear wall of the fireplace cavity.

9. The fireplace system of claim 8, further comprising at least one of:

a segmented high temperature high density refractory material disposed on at least a base portion of the grate;

a plurality of venting apertures disposed in a front portion of the grate; and one or more fuel retention bars disposed adjacent to the front portion of the grate.

10. The fireplace system of claim 1, wherein at least a portion of the plurality of combustion chambers include a common wall portion.

11. The fireplace system of claim 1, the secondary combustion assembly further comprising one or more flow directors extending into one or more of the one or more lower level combustion chambers, the one or more intermediate level combustion chambers, and the one or more upper level combustion chambers.

12. The fireplace system of claim 1, the secondary combustion assembly further comprising one or more flow interrupters extending into one or more of the one or more lower level combustion chambers, the one or more intermediate level combustion chambers, and the one or more upper level combustion chambers.

13. The fireplace system of claim 12, wherein the one or more flow interrupters include one or more of a cone shape, a pyramid shape, a dome shape, a cylinder shape, and a block shape.

14. The fireplace system of claim 1, wherein the top baffle is formed from one or more of a metallic material and a refractory material.

15. A retrofit fireplace assembly comprising:

a secondary combustion assembly configured for insertion adjacent to a rear wall of a fireplace cavity, wherein the secondary combustion assembly includes a plurality of combustion chambers configured to facilitate secondary combustion, the plurality of combustion chambers including a lower level combustion chamber, an intermediate level combustion chamber disposed above the lower level combustion chamber, and an upper level combustion chamber disposed above the intermediate level combustion chamber, and wherein each of the one or more lower level combustion chambers and the one or more intermediate level combustion chambers include an outlet opening in fluid communication with one or more of the one or more upper level combustion chambers; and a plurality of inlet openings disposed in a front wall of the secondary combustion assembly, wherein one or more of the plurality of inlet openings are configured to provide fluid communication between the fireplace cavity and a respective one of the plurality of combustion chambers, and wherein the plurality of inlet openings include:

one or more lower inlet openings corresponding to one or more of a plurality of inlets in a rear wall of the fireplace cavity and configured to provide fluid communication from the fireplace cavity to the one or more lower level combustion chambers;

one or more intermediate inlet openings corresponding to one or more of a plurality of inlets in a rear wall of the fireplace cavity and configured to provide fluid communication from the fireplace cavity to the one or more intermediate level combustion chambers; and one or more upper inlet openings corresponding to one or more of a plurality of inlets in a rear wall of the fireplace cavity and configured to provide fluid communication from the fireplace cavity to the one or more upper level combustion chambers.

16. The retrofit fireplace assembly of claim 15, the secondary combustion assembly further comprising one or more flow directors extending into one or more of the one or more lower level combustion chambers, the one or more intermediate level combustion chambers, and the one or more upper level combustion chambers.

17. The retrofit fireplace assembly of claim 15, the secondary combustion assembly further comprising one or more flow interrupters extending into one or more of the one or more lower level combustion chambers, the one or more intermediate level combustion chambers, and the one or more upper level combustion chambers.

* * * * *